US006482155B2

(12) United States Patent
Shitan

(10) Patent No.: US 6,482,155 B2
(45) Date of Patent: Nov. 19, 2002

(54) CALORIC VALUE CALCULATION DEVICE

(75) Inventor: Yasuhiro Shitan, Tokyo (JP)

(73) Assignee: Konami Sports Corporation, Tokyo (JP)

( * ) Notice: Subject to any disclaimer, the term of this patent is extended or adjusted under 35 U.S.C. 154(b) by 0 days.

(21) Appl. No.: 09/783,591

(22) Filed: Feb. 15, 2001

(65) Prior Publication Data

US 2002/0026102 A1 Feb. 28, 2002

(30) Foreign Application Priority Data

Aug. 30, 2000 (JP) ..... 2000-261399

(51) Int. Cl.[7] ..... A61B 5/00; A63D 5/00

(52) U.S. Cl. ..... 600/300; 128/921; 473/54; 700/91

(58) Field of Search ..... 463/1; 700/91, 700/92; 340/323 B; 473/54–130; 434/249

(56) References Cited

U.S. PATENT DOCUMENTS 4,330,123 A * 5/1982 Kleinerman ..... 434/249
4,893,182 A * 1/1990 Gautraud et al. ..... 348/579
6,095,949 A * 8/2000 Arai ..... 434/127
6,110,052 A * 8/2000 Spranger et al. ..... 340/323 B
6,270,421 B1 * 8/2001 Tsujita ..... 473/54

* cited by examiner

*Primary Examiner*—Eric F. Winakur
*Assistant Examiner*—David McCrosky
(74) *Attorney, Agent, or Firm*—Pillsbury Winthrop, LLP

(57) ABSTRACT

A caloric value calculation device of calculating a caloric value consumed by delivering a material body. A caloric value calculation device wherein a bowler calculates a consumed caloric value by delivering a bowl includes a personal information access unit for accessing personal information of the bowler; a bowl information access unit for accessing information of delivering the bowl by the bowler; a calorie calculation unit for calculating the caloric value consumed by the bowler based on the personal information and bowler information; and an output unit for outputting the caloric value calculated by the calorie calculation unit.

15 Claims, 9 Drawing Sheets

15

| BOWLER ID | AGE | SEX | WEIGHT | NUMBER OF STEPS | WEIGHT OF BALL |
|---|---|---|---|---|---|
| 0001 | 24 | MAN | 60kg | 4 | 13POUND |
| 0002 | 50 | WOMAN | 50kg | 3 | —— |
| 0003 | 38 | MAN | 55kg | 5 | 15POUND |
| ⋮ | ⋮ | ⋮ | ⋮ | ⋮ | ⋮ |

FIG. 2A

| BOWLER ID | CALORIE CONSUMPTION HISTORY | | | | CONSUMED CALORIES TOTAL |
|---|---|---|---|---|---|
| 0001 | 7/25, 210kcal | 7/30, 215kcal | 8/12, 195kcal | · · · | 1075kcal |
| 0002 | 7/25, 180kcal | —— | —— | · · · | 180kcal |
| 0003 | 7/25, 155kcal | 7/29, 170kcal | 7/29, 160kcal | · · · | 585kcal |
| ⋮ | ⋮ | ⋮ | ⋮ | ⋮ | ⋮ |

FIG. 2B

CALORIC VALUE CALCULATION DEVICE

This patent application claims priority from a Japanese patent application No. 2000-261399 filed on Aug. 30, 2000, the contents of which are incorporated herein by reference.

BACKGROUND OF THE INVENTION

1. Field of the Invention

The present invention relates to a caloric value calculation device. In particular, the present invention relates to a caloric value calculation device that calculates a caloric value consumed by delivering a material body.

2. Description of Related Art

Until now, a caloric value consumed by exercise has been calculated using a pedometer, a fitness bike, a fitness running machine, and so forth. For the pedometer, the consumed caloric value has been calculated by the number of steps. For the fitness bike, the consumed caloric value has been calculated by the supporting force of working a pedal and the time spent exercising. For the fitness running machine, the consumed caloric value has been calculated by total miles traveled in a given time.

However, it has not been used to measure a caloric value in an easy manner, which is consumed in a game such as bowling, a flying disc, a practice throw such as the shot-put, the discus throw, and the javelin throw.

SUMMARY OF THE INVENTION

It is a primary object of this invention to provide a caloric value calculation device capable of solving the above-mentioned problem. The object thereof can be attained by combining characteristics detailed in independent claims of the scope of claims. Furthermore, the dependent claims thereof further define advantageous embodiments of the present invention.

Namely, the first embodiment of the present invention is a caloric value calculation device wherein a bowler calculates a consumed caloric value by delivering a bowl including a personal information access unit for accessing personal information about the bowler; a bowl information access unit for accessing information about the bowl that was delivered by the bowler; a calorie calculation unit for calculating the caloric value consumed by the bowler based on both the personal and bowler information; and an output unit for outputting the caloric value calculated by the calorie calculation unit.

The caloric value calculation device may include a personal information database for storing at least one of age, sex, and weight of the bowler, a number of steps, and weight of bowl delivered by the bowler as the personal information of the bowler corresponding to identification information of the bowler, wherein the personal information access unit may access the personal information of the bowler from the personal information database based on the identification information of the bowler.

The caloric value calculation device may further include an image input unit for inputting delivery form of the bowler, wherein the bowl information access unit may access the bowlers number of steps at the time of bowling the bowl from the form of the bowler obtained by the image input unit.

The caloric value calculation device may further include a speed measuring unit for measuring a speed of a bowl delivered by the bowler, wherein the bowl information access unit may access the speed of the bowl measured by the speed measuring unit.

The caloric value calculation device may further include a weight measuring unit for measuring a weight of a bowl delivered by the bowler, wherein the bowl information access unit may access the speed of the bowl measured by the weight measuring unit.

The caloric value calculation device may further include an image input unit for inputting color of the bowl, wherein the weight determination unit may determine the weight of the delivered bowl based on the color of the delivered bowl, which is input by the image input unit.

The caloric value calculation device may further include a memory unit for storing each bowl speed delivered by each bowler, wherein the calorie calculation unit may calculate an average value of respective speeds of the delivered bowl, which are stored in the memory unit, and calculates the consumed caloric value of the bowler based on the weight of the delivered bowl, the average value of the speeds, and the number of deliveries.

The caloric value calculation device may further include a display unit for displaying the caloric value calculated by the calorie calculation unit.

The caloric value calculation device may further include a personal information database for storing each caloric value of each bowler, which is calculated by the calorie calculation unit, wherein the output unit may store the caloric value in the personal information database.

The caloric value calculation device may further include a score processing unit for processing score information of the bowler and storing history of the score information, wherein the bowl information access unit may access history of the score information.

Another preferred embodiment of the present invention is a calorie calculation method of calculating a caloric value which a bowler has consumed by delivering a bowl including the steps of obtaining personal information of the bowler; accessing delivery information of the bowler; and calculating the caloric value which the bowler has consumed based on the personal information and above-mentioned delivery information.

Another preferred embodiment of the present invention is a recording medium for storing a computer program for calculating a caloric value which a bowler has consumed by delivering a bowl, wherein the computer program including a first module of allowing the computer to access personal information of the bowler; a second input module of accessing delivery information about the bowler; a calculation module of calculating the caloric value which the bowler has consumed based on the personal information and above-mentioned delivery information; and an output module of outputting the caloric value which the calculation module has calculated.

Here, all of the necessary characteristics which the present invention requires are not disclosed in the summary of the invention, but sub-combinations of these characteristics can also be the present invention.

BRIEF DESCRIPTION OF THE DRAWINGS

While the specification concludes with claims particularly pointing out and distinctly claiming the subject matter which is regarded as the invention, it is believed that the invention, the object, features and advantages thereof will be better understood from the following description taken in connection with the accompanying drawings in which:

FIGS. 2A and 2B are data formats of a consumption calorie file stored in the personal information data base;

DETAILED DESCRIPTION OF THE INVENTION

The invention will now be described based on the preferred embodiments. This does not intend to limit the scope of the present invention, but rather exemplify the invention. All of the features and the combinations thereof described in the embodiments are not necessarily essential to the invention.

(First Embodiment)

Figure 1:
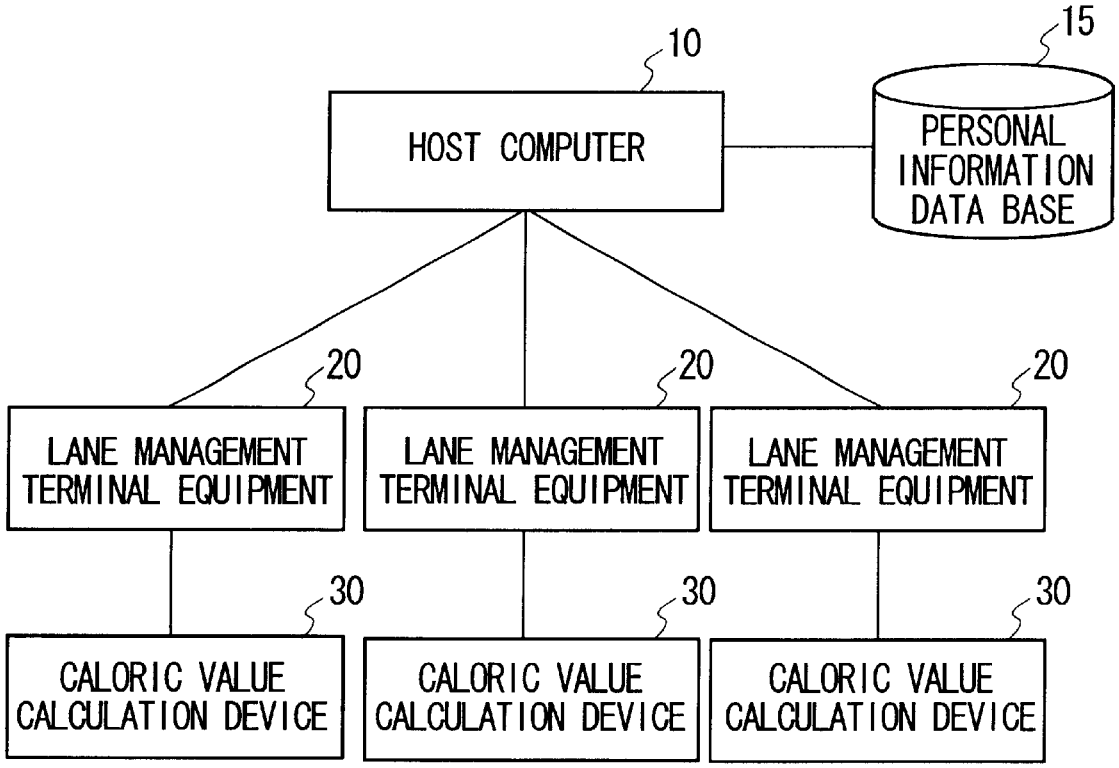
FIG. 1 is a calorie calculation system of the first preferred embodiment.

FIG. 1 is a block diagram of a caloric value calculation system of the first preferred embodiment. A system of the preferred embodiment includes a host computer 10 installed in front of a bowling center, a personal information data base 15 for storing personal information of a bowler, a lane management terminal equipment 20 that is provided in each lane, and a caloric value calculation device 30 that is connected to the lane management terminal equipment 20.

The host computer 10 is connected to the lane management terminal equipment 20 that is provided in each lane, and performs centralized management to a management system of the bowling center by transacting a variety of information between them. The lane management terminal equipment 20 mainly performs a scoring process of the bowling center, and displays the score thereof on a display. Furthermore, the lane management terminal equipment 20 displays a consumed caloric value, which is calculated by the caloric value calculation device 30, of the bowler.

FIG. 2A is a data format of a personal information file that is stored in the personal information data base 15. The personal information file includes respective fields of "BOWLER ID," "AGE," "SEX," "WEIGHT," "NUMBER OF STEPS," and "WEIGHT OF BALL." The information of identifying the bowler is stored in the field of "BOWLER ID." Age, sex, and the weight of the bowler identified by the bowler ID are stored in the fields of "AGE," "SEX," and "WEIGHT" respectively. The number of steps that the bowler requires when delivering, identified by the bowler ID, is stored in the field of "NUMBER OF STEPS." Weight of the bowl that the bowler uses, identified by the bowler ID, is stored in the field of "WEIGHT OF BALL." The bowler obtains a bowler ID by registering personal information in advance. Then, a caloric value consumed by the bowler by delivering the bowl is calculated based on personal information that is stored in the personal information data base 15 corresponding to the bowler ID simply by inputting the bowler ID in the lane management terminal equipment 20.

FIG. 2B is a data format of a consumption calorie file stored in the personal information data base 15. The consumption calorie file includes respective fields of "BOWLER ID," "CALORIE CONSUMPTION HISTORY," and "CONSUMED CALORIES TOTAL." Information for identifying the bowler is stored in the field of "BOWLER ID." The month and date when the bowler has played the bowling game, identified by the bowler ID, and the caloric value that is consumed by the delivering thereof are stored in the field of "CALORIE CONSUMPTION HISTORY." The total of consumed caloric values stored in the field of the "CALORIE CONSUMPTION HISTORY" is stored in the field of "CONSUMED CALORIES TOTAL." The bowler can read when the bowler consumed the calories and what calories the bowler consumed using a printer and/or terminal equipment for outputting information stored in the personal information data base 15.

Figure 3:
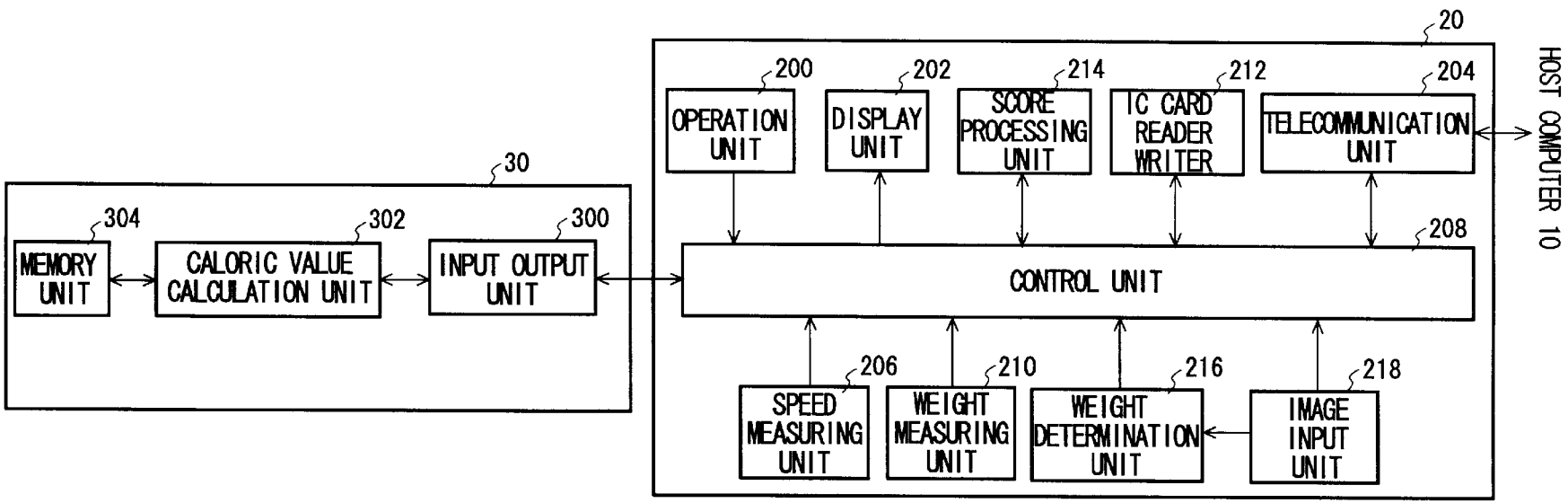
FIG. 3 is a block diagram of functions of the caloric value calculation device and the lane management terminal equipment.

FIG. 3 is a block diagram showing functions of the caloric value calculation device 30 and the lane management terminal equipment 20 of the present invention. The lane management terminal equipment 20 includes an operation unit 200, a display unit 202, a telecommunication unit 204, a speed measuring unit 206, a control unit 208, a weight measuring unit 210, an IC card reader writer 212, a score processing unit 214, a weight determination unit 216, and an image input unit 218. The control unit 208 controls the operation of the respective units. Furthermore, the caloric value calculation device 30 includes an input output unit 300, a caloric value calculation unit 302, and a memory unit 304. The input output unit 300 is an example of a personal information acquisition unit, a bowling information acquisition unit, and an output unit. The score processing unit 214 is an example of a score processing unit.

In the front host computer 10, the name of the bowler is input and then the lane is designated to the bowler. Furthermore, the telecommunication unit 204 of the lane management terminal equipment 20 receives the name of the bowler and information for indicating starting the game, from the host computer 10. The display unit 202 displays a scoreboard where the name of the bowler is displayed.

A bowler, who has registered personal information in advance, inputs the bowler ID using the operation unit 200. Personal information, which has already been stored corresponding to the input bowler ID, is extracted from the personal information data base 15, and the input output unit 300 of the caloric value calculation device 30 inputs personal information by way of the lane management terminal equipment 20. A bowler who has not registered personal information in advance inputs personal information in a direct manner using the operation unit 200, and allows the input output unit 300 to input using the caloric value calculation device 30. Furthermore, it is also possible to input personal information using an IC card reader writer 212 after personal information has been stored in an IC card. The speed measuring unit 206 measures the speed of a delivered bowl, and the speed of the bowl, which is measured, is input to the caloric value calculation device 30.

In accordance with the bowler's situation, the weight of the bowl may not be settled, or plural bowls, each weight of which is not equal to each other, may be used. In such a case, the bowler may input the weight of the bowl using the operation unit 200 every time the bowler delivers. Furthermore, the weight measuring unit 210 that a bowl stock person equips may measure the weight of the bowl. Further, since most of the bowls provided in the bowling center are color-classified corresponding to each weight, it may also be possible that the image input unit 218 inputs the image of the delivered bowl and the weight determination unit 216 determines the weight of the bowl based on the color of the bowl, which is input by the image input unit 218.

Further still, the image input unit 218 may input delivery form of the bowler and obtain the number of steps required by the bowler when delivering.

The caloric value calculation unit 302 of the caloric value calculation device 30 calculates the caloric value which the bowler has consumed by delivering based on age, sex, weight, the number of steps in the delivery, the weight of the bowl, and the speed of the bowl that are input by the input output unit 300. The memory unit 304 memorizes the consumed caloric value calculated by the caloric value calculation unit 302, personal information that is input by the input output unit 300, the speed of the bowl, and so forth.

The score processing unit 214 calculates the score of the bowler who plays in the lane thereof. The display unit 202 displays the score calculated by the score processing unit 214, the speed of the bowl measured by the speed measuring unit 206, and the consumed caloric value calculated by the caloric value calculation unit 302, and then notifies the bowler.

Figure 4:
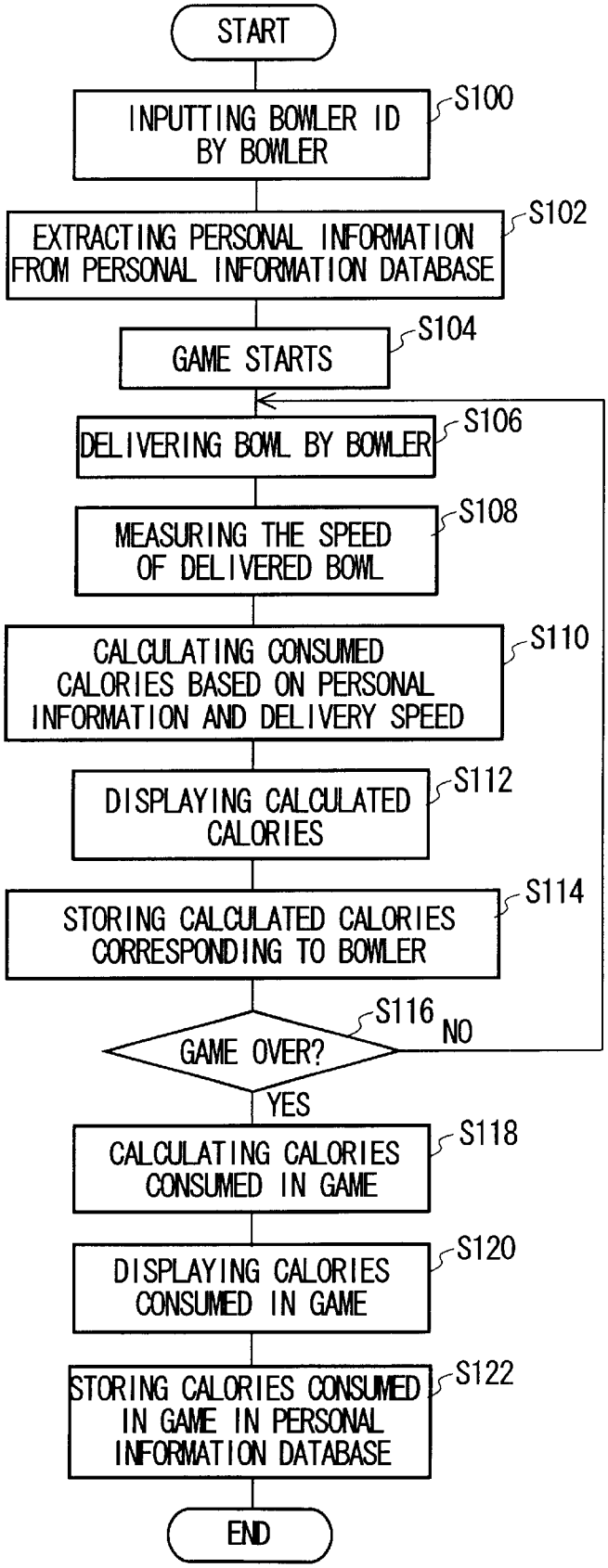
FIG. 4 is a flowchart of the caloric value calculation process of the preferred embodiment.

FIG. 4 is a flowchart of the caloric value calculation process of the preferred embodiment. The bowler ID is input from the operation unit 200 by the bowler (S100). The control unit 208 extracts personal information (age, sex, weight, the number of steps, and the weight of the bowl) that is stored corresponding to the input bowler ID from the personal information data base 15, and then inputs to the input output unit 300 of the caloric value calculation device 30 (S102). The game starts (S104). When the bowler delivers the bowl (S106), the speed measuring unit 206 measures the speed of the delivered bowl (S108). The caloric value calculation unit 302 of the caloric value calculation device 30 calculates the consumed caloric value of delivering the bowl therefor based on the speed of the bowl which the speed measuring unit 206 has measured (S110). The display unit 202 displays the consumed caloric value calculated by the caloric value calculation unit 302 (S112). The memory unit 304 memorizes the consumed caloric value calculated by the caloric value calculation unit 302 corresponding to the bowler (S114). The control unit 208 determines whether the game is over or not (S116) When the game is not over, the bowler delivers the next bowl, and the same process is repeated. When the game is over, the caloric value calculation unit 302 totals the respective consumed caloric values of delivered bowls, which are memorized in the memory unit 304, and then calculates the consumed caloric value of the game (S118). The display unit 202 displays the consumed caloric value of the game, which is calculated by the caloric value calculation unit 302 (S102). The consumed caloric value of the game is sent to the host computer 10 from the telecommunication unit 204, and then stored in the personal information data base 15 corresponding to the bowler ID (S122)

Figure 5:
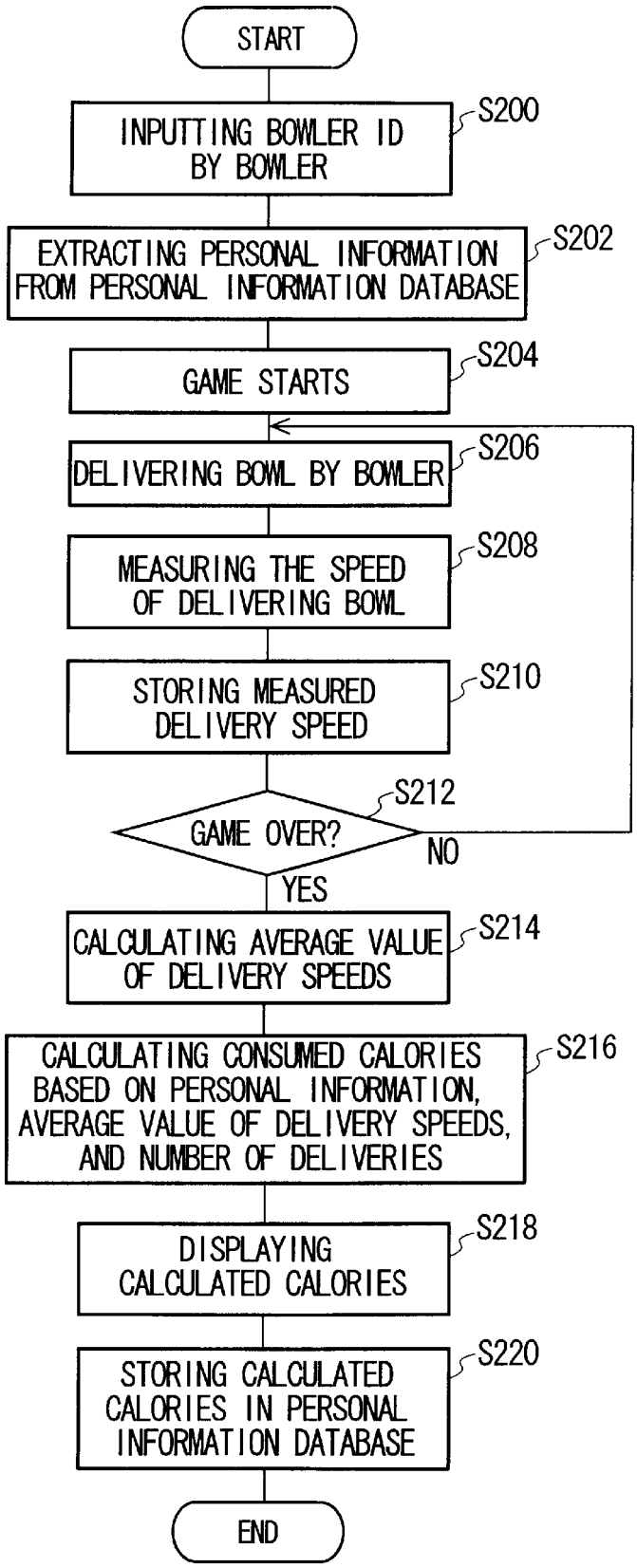
FIG. 5 is a flowchart of another caloric value calculation process of the present invention.

FIG. 5 is a flowchart of another caloric value calculation process of the present invention. In the caloric value calculation process explained in the foregoing using FIG. 4, the consumed caloric value of each delivery is calculated using each speed of the bowl every time the bowl is delivered and then the consumed caloric value of the game is calculated by totaling the caloric values of the respective deliveries. On the other hand, in the caloric value calculation process of FIG. 5, the consumed caloric value of the game is calculated by calculating an average value of the bowl speed of the game thereof and using the average value of the speed of the bowl and the number of deliveries.

The bowler ID is input from the operation unit 200 by the bowler (S200). The control unit 208 extracts personal information (age, sex, weight, the number of steps, and the weight of the bowl) that is stored corresponding to the input bowler from the personal information data base 15, and input to the input output unit 300 of the caloric value calculation device 30 (S202). The game starts (S204). When the bowler delivers the bowl (S206), the speed measuring unit 206 measures the speed of the delivered bowl (S208). The memory unit 304 of the caloric value calculation device 30 memorizes the speed of the bowl which the speed measuring unit 206 has measured corresponding to the bowler (S210). The control unit 208 determines whether the game is over or not (S212). When the game is not over, the bowler delivers the next bowl, and the same process is repeated. When the game is over, the caloric value calculation unit 302 calculates the average value of the speed of the bowl, which is memorized in the memory unit 304 (S214). The caloric value calculation unit 302 calculates the consumed caloric values of the game thereof based on personal information extracted from the personal information data base 15, the average value of the speed of the bowl, and the number of deliveries (S216). The display unit 202 displays the consumed caloric value of the game, which is calculated by the caloric value calculation unit 302 (S218). The consumed caloric value of the game is sent to the host computer 10 from the telecommunication unit 204, and then stored in the personal information data base 15 corresponding to the bowler ID (S220).

Figure 6A:
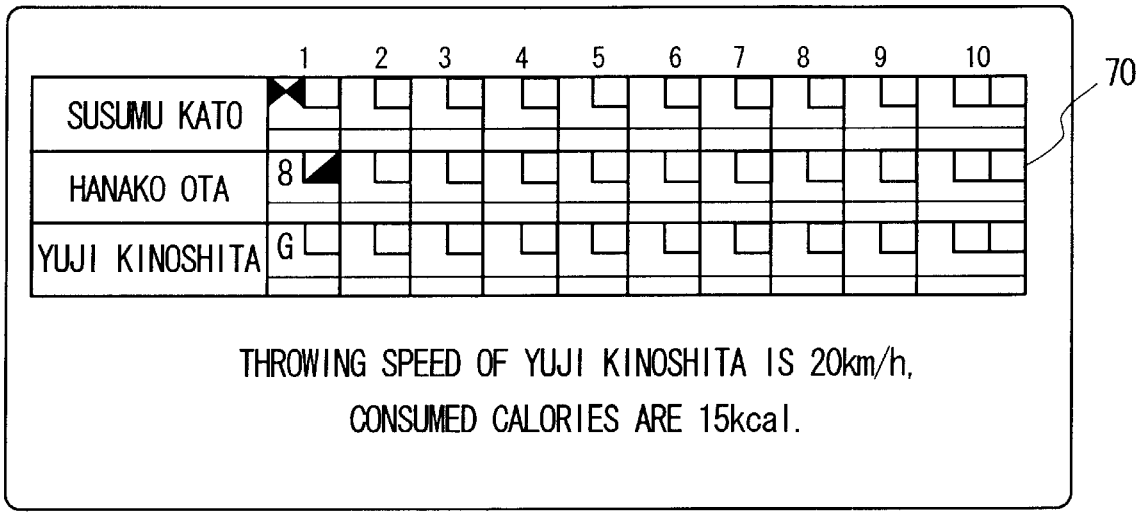
FIGS. 6A and 6B are examples of a display unit screen.

FIG. 6A is an example of a screen that the display unit 202 displays every time the bowl is delivered. The display unit 202 displays a score 70 calculated by the score processing unit 214, and the contents of the display are updated every time the bowl is delivered. Furthermore, the display unit 202 displays the speed of the bowl that the bowler has delivered, and the consumed caloric value by delivering the bowl every time the bowl is delivered.

Figure 6B:
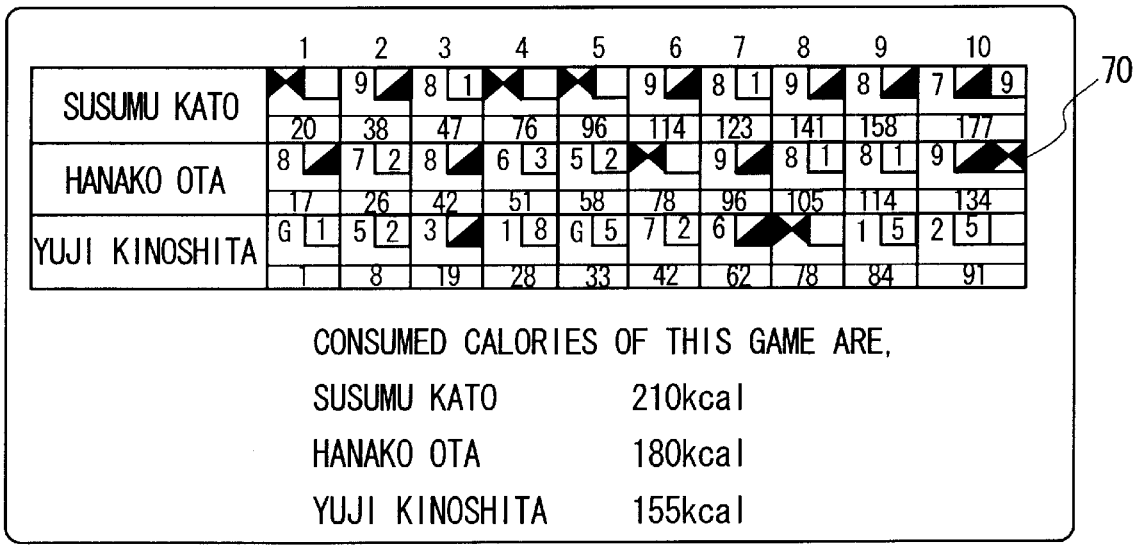

FIG. 6B is an example of a screen that the display unit 202 displays after the game is over. The display unit 202 displays, after the game is over, the consumed caloric value of each bowler of the game thereof while the display unit 202 displays the score 70 calculated by the score processing unit 214.

According to the explanation in the foregoing, although the caloric value calculation unit 302 calculates a caloric value consumed when the bowl is delivered based on age, sex, and the weight of the bowler, the number of steps of delivering the bowl, the weight of the bowl, and the speed of the bowl, the consumed caloric value may be calculated by taking the score of bowling into account. For example, for delivering the bowl when the number of residual pins is 1 or 2 or in the case of a split, since there is a tendency in which the heart rate of the bowler becomes high, the consumed caloric value of delivering the bowl becomes high. Therefore, the caloric value calculation unit 302 may calculate the consumed caloric value of delivering the bowl by considering information of the score of delivering the bowl, which is obtained at a past time from the score processing unit 214. Especially in a sport which has a characteristic of the game, it is possible to obtain a highly reliable result by considering a psychological aspect of a player other than a motion of exercise and calculating the consumed caloric value.

According to the explanation in the foregoing, although the explanation is made using the case where the consumed caloric value in the bowling is calculated, it may also be possible to calculate the consumed caloric value in the motion of delivering a material body other than a ball, such as a flying disc, the javelin throw, the discus throw, and so forth.

According to the present invention, it is possible in a simple manner to measure the consumed caloric value of delivering the bowl from the weight and the speed of the delivered material body without using information, which is acquired from the human body, such as breathing, the heart rate, the pulse rate, and so forth.

(Second Embodiment)

Figure 7:
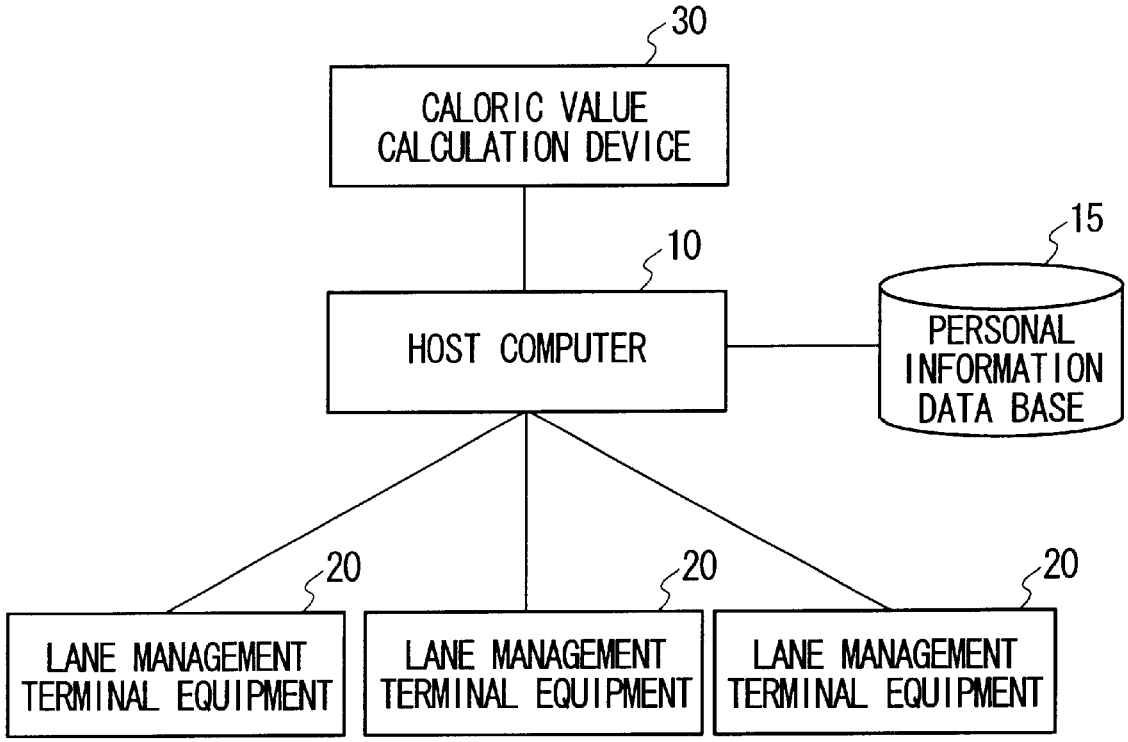
FIG. 7 is a block diagram of a caloric value calculation system of the second preferred embodiment.

Next, the second embodiment is herein explained. FIG. 7 is a block diagram of a caloric value calculation system of the preferred embodiment of the present invention. The caloric value calculation device 30 is connected to the host computer 10 of the bowling center, and extracts personal information from the personal information data base 15 connected to the host computer 10. Furthermore, the caloric value calculation device 30 gets bowler information of delivering the bowl from the lane management terminal equipment 20 by way of the host computer 10, and then performs a calculation process of the consumed caloric value. In accordance with the preferred embodiment, it is possible to calculate the consumed caloric value of the bowler delivering the bowl in each lane by providing one caloric value calculation device 30 in the bowling center.

(Third Embodiment)

Figure 8:
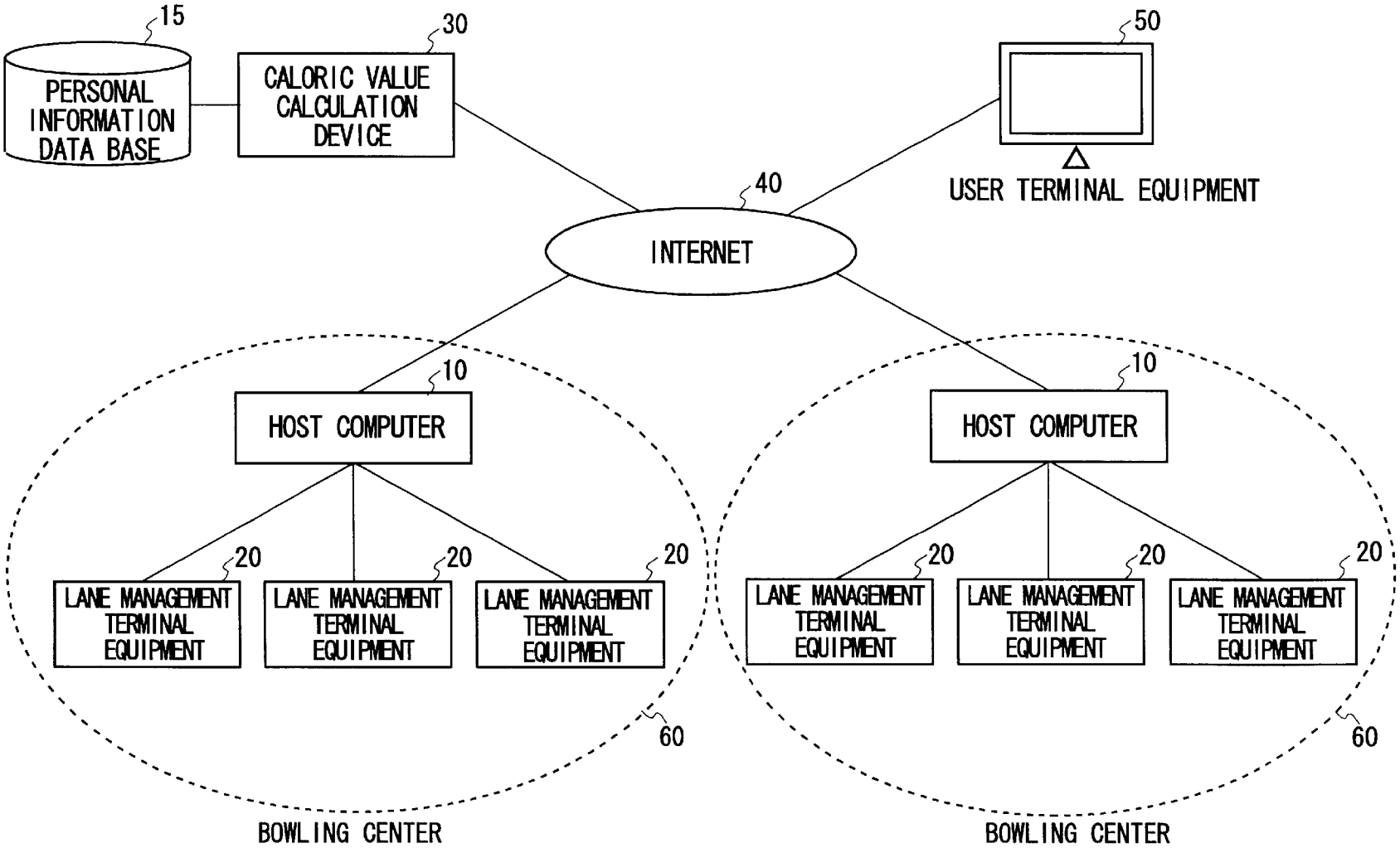
FIG. 8 is a block diagram of a caloric value calculation system of the third preferred embodiment.

Next, the third embodiment is herein explained. FIG. 8 is a block diagram of a caloric value calculation system of the preferred embodiment of the present invention. The caloric value calculation device 30 of the preferred embodiment is connected to the host computer 10 of a bowling center 60 by way of the Internet. The caloric value calculation device 30 extracts the bowler personal information from the personal information data base 15, gets information of the bowl delivered by the bowler, which the host computer 10 has received from the lane management terminal equipment 20, byway of the Internet 40, and then performs the calculation process of the consumed caloric value. In accordance with the system of the preferred embodiment, the bowler is capable of reading information stored in the personal information data base 15 connected to the caloric value calculation device 30 by connecting to the caloric value calculation device 30 using user terminal equipment 50. Furthermore, the bowler is capable of registering personal information by connecting to the caloric value calculation device 30 using the user terminal equipment 50.

(Fourth Embodiment)

Figure 9:
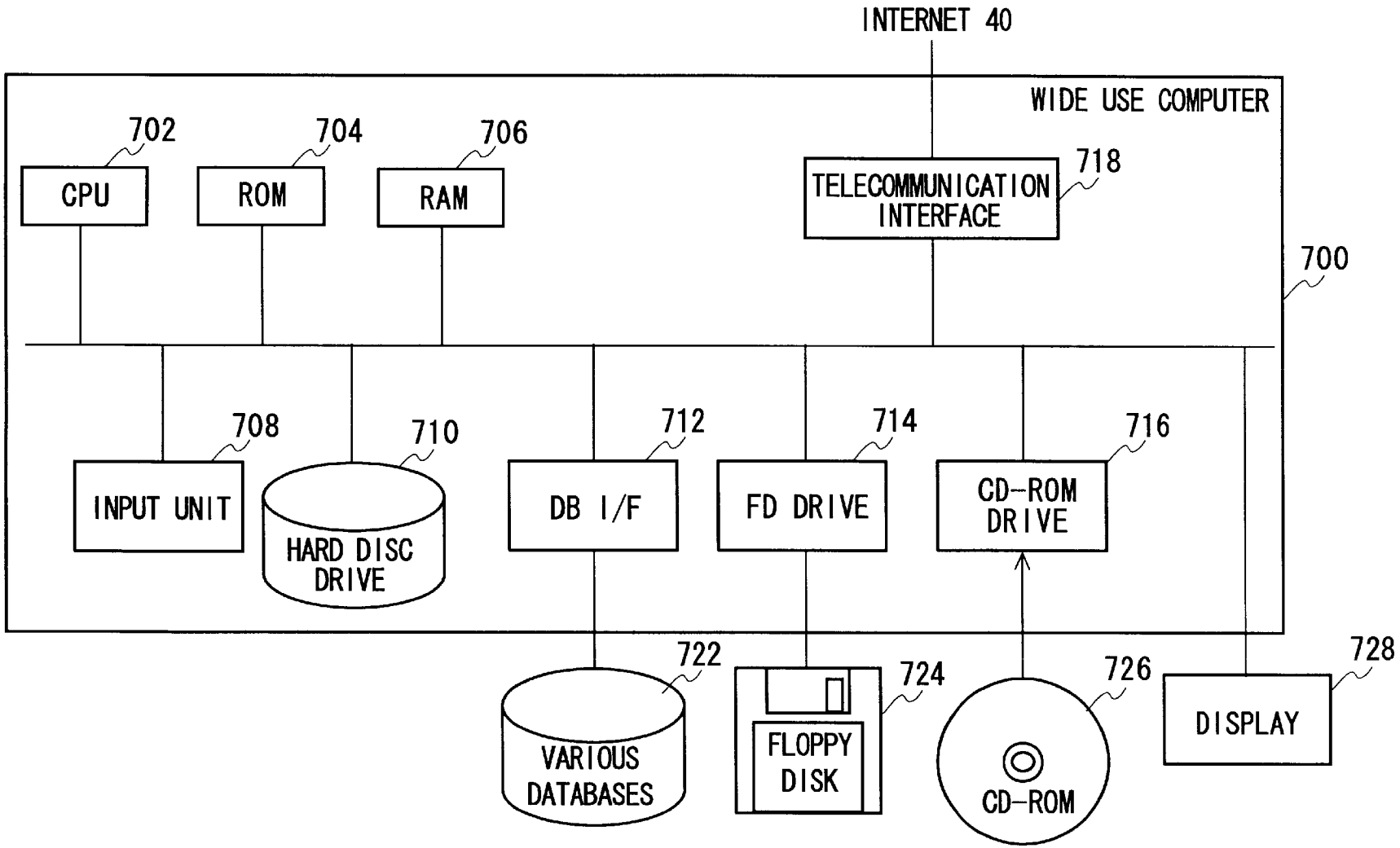
FIG. 9 is a block diagram of functions of hardware of a wide use computer.

The first, second, and third preferred embodiments of the caloric value calculation device 30 may be made by a wide use computer. FIG. 9 is a block diagram showing functions of hardware of a wide use computer 700. In FIG. 9, for the wide use computer 700, CPU 702 operates based on programs stored in ROM 704 and RAM 706. An administrator of the caloric value calculation device 30 can input data and commands by an input unit 708. A hard disc drive 710 as an example of a storage device that stores setting information and programs for operating CPU 702.

A floppy disc drive 714 reads out data or programs from a floppy disc 724 and provides them for CPU 702. CD-ROM drive 716 reads out data or programs from CD-ROM 726 and provides them for CPU 702. A telecommunication interface 718 sends and/or receives data by connecting to the Internet 40. A data base interface 712 sends and/or receives database data by connecting to various kinds of databases 722. Furthermore, the wide use computer 700 equips an interface for connection with a display 728, and the administrator is capable of monitoring a running condition and verifies a setting condition by the display 728.

Software which CPU 702 performs is provided for the user by being stored in a recording medium such as the floppy disc 724, CD-ROM 726, etc. Software stored in the recording medium may be either compressed or non-compressed. Software is installed in the hard disc drive 710 from the recording medium, then read/written out in RAM 706, and performed by CPU 702.

The structure and operation of functions of software which are provided by being stored in the recording medium, that is to say, of software which is installed in the hard disc drive 710, are the same as the structure and operation of functions of the caloric value calculation device 30 of the first preferred embodiment, thus the explanation is omitted.

A part, or all of the functions, of an operation of the caloric value calculation device 30 in relation to the preferred embodiment described in the present application, are capable of being stored in CD-ROM 726 or floppy disc 724 as an example of the recording medium, shown in FIG. 9.

It is possible for such programs to be performed by being read/written out in RAM from the recording medium directly or by being read/written out in RAM after being installed in the hard disc drive. Furthermore, it is also possible for the above-mentioned programs to be stored in a single recording medium or in a plural recording media. Furthermore, it is possible to store using a coded form.

As the recording media, it is possible to utilize an optical recording medium such as DVD, a magnetic recording medium such as MD, an optical magnetic recording medium such as FD, a tape medium, a magnetic recording medium, a semiconductor memory such as an IC card, or a miniature card other than the floppy disc and CD-ROM. Furthermore, a storage device such as RAM or a hard disc provided in a server system that is connected to an exclusive telecommunication network or the Internet may be utilized as a recording medium, and then programs may be provided for the wide use computer 700 of the preferred embodiment as a music composing device of the present invention by way of a telecommunication network. Such recording media are utilized only for fabricating the caloric value calculation device of the present invention. Therefore, it is obvious that it infringes on the patent right based on the present application to sell or fabricate such recording media as trade.

In the foregoing, although the present invention has been explained using the preferred embodiments, the technical scope of the present invention shall not be limited to the scope of claims of the above-mentioned preferred embodiments. It is possible to alter, modify, and variously improve the above-mentioned embodiments. It is also obvious as defined in the scope of claims that such alterations, modifications and improvements are intended to be within the spirit and technical scope of the invention.

As clearly explained in the foregoing, in accordance with the present invention, it is possible to provide the caloric value calculation device that calculates the consumed caloric value by delivering the material body.

What is claimed is:

1. A caloric value calculation device which calculates a number of calories consumed by a bowler delivering a bowling ball, comprising:

a personal information access unit for accessing personal information of the bowler;

a bowl information access unit for accessing bowling information including information relating to the bowling ball delivered by the bowler;

a calorie calculation unit for calculating the caloric value consumed by the bowler based on said personal information and bowling information; and an output unit for outputting the caloric value calculated by said caloric calculation unit.

2. A caloric value calculation device according to claim 1, further comprising:

a personal information database for storing said personal information including at least one of age, sex, weight of the bowler, and weight of a bowling ball delivered by the bowler corresponding to identification information of the bowler, wherein said personal information access unit accesses said personal information of the bowler from said personal information database based on said identification information of the bowler.

3. A caloric calculation device according to claim 1, wherein said caloric calculation unit calculates the caloric value further based on the number of footsteps walked by the bowler at the time of delivering the material body.

4. A caloric value calculation device according to claim 3, further comprising:

an image input unit for inputting delivery form of the bowler, wherein said bowling information access unit accesses the number of footsteps of the bowler at the time of delivering the bowling ball from the form of the bowler obtained by said image input unit.

5. A caloric value calculation device according to claim 1, further comprising:

a speed measuring unit for measuring a speed of the bowling ball delivered by the bowler, wherein said bowling information access unit accesses the speed of the bowling ball as the bowling information, measured by said speed measuring unit.

6. A caloric value calculation device according to claim 1, further comprising:

a weight measuring unit for measuring a weight of the bowling ball as the bowling information delivered by the bowler, wherein said bowling information access unit accesses the weight of the bowling ball measured by said weight measuring unit.

7. A caloric value calculation device according to claim 1, further comprising:

a weight determination unit for determining weight of the bowling ball delivered by the bowler; and wherein said bowling information access unit accesses the weight of the bowling ball as the bowling information determined by said weight determination unit.

8. A caloric value calculation device according to claim 7, further comprising:

an image input unit for inputting color of the bowling ball wherein the color represents a certain weight of the bowling ball, wherein said weight determination unit determines the weight of the delivered bowling ball based on said color of the delivered bowling ball, which is input by said image input unit.

9. A caloric value calculation device according to claim 1, further comprising:

a memory unit for storing each speed of the bowling ball delivered by each bowler, wherein said calorie calculation unit calculates an average value of respective speeds of the delivered bowling ball, which are stored in said memory unit, and calculates the consumed caloric value of the bowler based on the weight of the delivered bowling ball, the average value of the speeds, and the number of deliveries.

10. A caloric value calculation device according to claim 1, further comprising:

a score processing unit for processing score information of the bowler and storing history of said score information, wherein said bowling information access unit accesses the history of said score information.

11. A caloric value calculation device according to claim 1, further comprising:

a display unit for displaying the caloric value calculated by said calorie calculation unit.

12. A caloric value calculation device according to claim 1, further comprising:

a personal information database for storing each caloric value of each bowler, which is calculated by said calorie calculation unit, wherein said output unit stores the caloric value in said personal information database.

13. A calorie calculation method of calculating a caloric value that a bowler has consumed by delivering a bowling ball, comprising the steps of:

obtaining personal information of the bowler;

accessing delivery information of the bowler; and calculating the caloric value which the bowler has consumed based on said personal information and said delivery information.

14. A recording medium for storing a computer program of calculating a caloric value which a bowler has consumed by delivering a bowling ball, the computer program comprising:

a first module causing a computer to access personal information of the bowler;

a second input module of accessing delivery information of the bowler;

a calculation module of calculating the caloric value which the bowler has consumed based on said personal information and said delivery information; and an output module of outputting the caloric value which said calculation module has calculated.

15. A caloric value calculation system which calculates a consumed caloric value by delivering a material body by a bowler, comprising:

a personal information database storing personal information of the bowler;

a host computer including a lane management terminal unit obtaining bowling information related to delivery of the material body by the bowler at a lane;

a personal information access unit for accessing the personal information of the bowler at the lane in the personal information database through a network;

an information access unit for accessing the bowling information of the bowler at the lane obtained by the lane management terminal unit through the network;

a caloric calculation unit for calculating the caloric value consumed by the bowler based on said personal information and bowling information; and a user terminal unit for receiving the caloric value calculated by said caloric calculation unit through the network and for outputting the received caloric value.

* * * * *